US007430876B2

(12) United States Patent
Iguchi et al.

(10) Patent No.: US 7,430,876 B2
(45) Date of Patent: Oct. 7, 2008

(54) COLD STORAGE

(75) Inventors: Harunobu Iguchi, Ota (JP); Yuji Yonehara, Ora-gun (JP)

(73) Assignee: Sanyo Electric Co., Ltd., Moriguchi-Shi (JP)

( * ) Notice: Subject to any disclaimer, the term of this patent is extended or adjusted under 35 U.S.C. 154(b) by 57 days.

(21) Appl. No.: 11/091,481

(22) Filed: Mar. 29, 2005

(65) Prior Publication Data

US 2005/0217301 A1 Oct. 6, 2005

(30) Foreign Application Priority Data

Mar. 31, 2004 (JP) ..... 2004-102979

(51) Int. Cl.
*A47F 3/04* (2006.01)

(52) U.S. Cl. ..... 62/255; 62/298

(58) Field of Classification Search ..... 62/246–256, 62/298

See application file for complete search history.

(56) References Cited

U.S. PATENT DOCUMENTS 3,230,733 A * 1/1966 Rutishauser et al. ..... 62/256
4,949,554 A * 8/1990 Branz et al. ..... 62/248
5,417,079 A * 5/1995 Rudick et al. ..... 62/253
6,948,324 B2 * 9/2005 Jin ..... 62/77

FOREIGN PATENT DOCUMENTS

JP 2000-105058 4/2000

* cited by examiner

*Primary Examiner*—William E Tapolcai
(74) *Attorney, Agent, or Firm*—Kratz, Quintos & Hanson, LLP.

(57) ABSTRACT

An object is to provide a cold storage in which a cooling box is attached to a bottom wall of a thermal insulation box member without any trouble, cold air circulation is constituted in such a manner that cold air which has exchanged heat with a cooler is discharged into a storage chamber by an air blower via a cold air discharge port, and sucked into a cooling chamber via a cold air suction port, and the inside of the storage chamber can be cooled. A mechanical chamber is constituted under the storage chamber constituted in the thermal insulation box member, and the cold storage comprises: a cooling unit in which a cooler and a blower contained in the cooling chamber constituted in the cooling box, a compressor, a condenser and the like are arranged and integrated; and the cold air discharge port and the cold air suction port which are formed in the bottom wall of the thermal insulation box member constituting a ceiling of the mechanical chamber and which connect the inside of the storage chamber to that of the mechanical chamber. The compressor, condenser and the like are disposed on an attachment base, the cooling box is disposed on the attachment base in such a manner as to be movable to upper/lower positions, and the only cooling box is pushed up in a direction of the bottom wall.

10 Claims, 16 Drawing Sheets

COLD STORAGE

BACKGROUND OF THE INVENTION

The present invention relates to a cold storage in which a cooling unit comprising a compressor or a cooler is incorporated under a thermal insulation box member containing a storage chamber.

In this type of cold storage 100 which has heretofore been used as a low-temperature showcase, as shown in FIG. 18 which is an enlarged sectional view of a lower part of the cold storage 100, a mechanical chamber 103 is constituted under a storage chamber 102 constituted in a thermal insulation box member 101, and a cold air discharge port 104 and a cold air suction port 105 which communicate with the inside of the mechanical chamber 103 are formed in a bottom wall 101A of the thermal insulation box member 101. A cooling box 106 having an opening in an upper face thereof is disposed in the mechanical chamber 103 in such a manner as to abut on the bottom wall 101A of the thermal insulation box member 101, and a cooler 107 and a cooler air blower 108 constituting a cooling unit 100R are disposed in the cooling box 106. Moreover, the inside of the storage chamber 102 is connected to the cooling box 106 via the cold air suction port 105 and the cold air discharge port 104. In a lower part of the cooling box of the mechanical chamber 103, a compressor 111, a condenser 112, a condenser air blower 113 and the like constituting the cooling unit 100R together with the cooler 107 are disposed on an attachment base 110 comprising moving casters 109 . . . on a bottom face thereof to constitute a known refrigerant circuit.

Moreover, the cooling box 106 is disposed above the attachment base 110 by cooling box supporting pieces 114, 114, and is detachably attached to the bottom wall 101A of the thermal insulation box member 101. The cooling box 106, cooler 107, cooler air blower 108, compressor 111, condenser 112 and the like are removably inserted in the mechanical chamber 103 together with the attachment base 110 using the casters 109, and the cooling unit 100R is detachable from the thermal insulation box member 101 (see Japanese Patent Application Laid-Open No. 2000-105058).

Moreover, as shown in enlarged views of FIGS. 19 and 20, the cold air discharge port 104 and the cold air suction port 105 formed in the bottom wall 101A of the thermal insulation box member 101 are constituted by attaching passage members 120 and 122 to openings formed in the bottom wall 101A. These passage members 120 and 122 are attached to the bottom wall 101A of the thermal insulation box member 101, while upper ends are allowed to abut on downward flanges 101C formed on opening edges of the bottom face of an inner box 101B constituting the thermal insulation box member 101 on a storage chamber 102 side. Lower ends of the members are allowed to abut on upward flanges 101E formed on opening edges of the bottom face of an outer box 101D constituting the thermal insulation box member 101 on a non-insulating material 101F side via flange members 124.

Accordingly, dew condensation or the like generated in the storage chamber 102 are passed downwards to the cooling box 106 via the cold air discharge port 104 and cold air suction port 105 provided with the passage members 120 and 122. This overflow port 125 is formed in the bottom wall of the cooling box 106, and connected to a water discharge hose 127 whose one end is connected to an evaporation tray 126. Therefore, the dew condensation passed downwards in the cooling box 106 from the storage chamber 102, and the dew condensation generated in the cooler 107 are supplied to the evaporation tray 126 via the overflow port 125 and water discharge hose 127, and evaporated.

However, in the conventional constitution described above, cold air leaks from a gap generated between the upper face opening of the cooling box 106, and the cold air discharge port 104 and cold air suction port 105. Therefore, after storing the attachment base 110 in the mechanical chamber 103, the cooling box 106 provided with the cooler 107 and cooler air blower 108 has to be lifted up, and fixed to the bottom wall 101A of the thermal insulation box member 101 by fixing pieces (not shown). Therefore, there is a problem that an attaching operation property of the cooling unit 100R becomes complicated. At this time, the cooling box 106 is fixed to positions corresponding to the cold air suction port 105 and the cold air discharge port 104 formed in the bottom wall 101A of the thermal insulation box member 101. There has been a problem that it is difficult to position the box, and the operation property is further deteriorated.

To solve the problem, it has heretofore been considered that fixing pieces (not shown) are disposed in order to raise the whole cooling unit 100R onto the bottom wall 101A of the thermal insulation box member 101 to achieve communication of the inside of the cooling box 106 of the cooling unit 100R with the cold air suction port 105 and the cold air discharge port 104 formed in the bottom wall 101A of the thermal insulation box member 101. However, in this constitution, since weight of the whole cooling unit 100R is large, a raising operation becomes complicated, burdens on the raising fixing pieces increase, and the whole cooling unit 100R lowers by its own weight. There has been a problem that the cold air leaks from the gap generated between the upper face opening of the cooling box 106, and the cold air discharge port 104 and cold air suction port 105.

Moreover, the cold air suction port 105 and the cold air discharge port 104 formed in the bottom wall 101A of the conventional thermal insulation box member 101 are constituted, when the upper ends of the respective passage members 120, 122 abut on the upper face of the bottom wall 101A of the thermal insulation box member 101. Therefore, the dew condensation generated in the storage chamber 102 cannot flow into the cold air suction port 105 or the cold air discharge port 104 unless flowing beyond the upper ends of the respective passage members 120, 122. Therefore, a flowing water path of the dew condensation is interrupted by the upper ends of the passage members 120, 122, and there is a problem that treatment efficiency of the dew condensation is bad.

Moreover, the dew condensation that does not flow beyond the respective passage members 120, 122 permeates between the respective passage members 120, 122, and the thermal insulation box member 101, and reaches the insulating material 101F constituting the thermal insulation box member 101. Consequently, there is a problem that the thermal insulation box member 101 is corroded. Therefore, as shown in FIG. 18, an overflow port 128 connected to a cooling box 106 side is separately disposed between the cold air suction port 105 and the cold air discharge port 104 of the bottom wall 101A, and the flowing water path of the dew condensation has been secured. However, in this constitution, since the number of components increases, there has been a problem that rise of costs and complication of operation are caused.

SUMMARY OF THE INVENTION

According to the present invention, there is provided a cold storage in which a mechanical chamber is constituted under a storage chamber constituted in a thermal insulation box member, comprising: a cooling unit in which a cooler and a blower contained in a cooling chamber constituted in a cooling box, a compressor, a condenser and the like are arranged and integrated; and a cold air discharge port and a cold air suction port which are formed in a bottom wall of the thermal insulation box member constituting a ceiling of the mechanical chamber and which connect the inside of the storage chamber to that of the mechanical chamber, wherein the compressor, the condenser and the like are disposed on an attachment base, the cooling box is disposed on the attachment base in such a manner as to be movable to upper/lower positions, and the only cooling box is pushed up in a direction of the bottom wall.

In the present invention, the cold storage in which the mechanical chamber is constituted under the storage chamber constituted in the thermal insulation box member comprises: the cooling unit in which the cooler and blower contained in the cooling chamber constituted in the cooling box, the compressor, the condenser and the like are arranged and integrated; and the cold air discharge port and cold air suction port which are formed in the bottom wall of the thermal insulation box member constituting the ceiling of the mechanical chamber and which connect the inside of the storage chamber to that of the mechanical chamber. The compressor, condenser and the like are disposed on the attachment base, the cooling box is disposed on the attachment base in such a manner as to be movable to the upper/lower positions, and the only cooling box is pushed up in the direction of the bottom wall. Therefore, the only cooling box can be pushed up toward the thermal insulation box member, and pressed onto the bottom wall side of the thermal insulation box member.

Consequently, the cooling box is attached to the bottom wall of the thermal insulation box member without any problem, cold air circulation is constituted in such a manner that cold air which has exchanged heat with the cooler is discharged into the storage chamber by the air blower via the cold air discharge port, and sucked into the cooling chamber via the cold air suction port, and the inside of the storage chamber can be cooled. Especially, according to the present invention, since the only cooling box is pushed up, operation is lightened, and operability can be enhanced. As compared with a conventional constitution in which the whole cooling unit is pushed up toward the bottom wall of the thermal insulation box member, in the present invention, since the only cooling box is pushed up, a weight to be pushed up is reduced, the unit in an attached state lowers by its own weight, and a disadvantage that adhesion•sealability with respect to the thermal insulation box member is deteriorated can be inhibited.

Moreover, the cold storage of the present invention comprises: a pushup mechanism comprising: a pair of hanging rails disposed on opposite side upper portions of the cooling box; and a pair of support rails which are positioned on opposite sides of the cold air discharge port and the cold air suction port and which are disposed on the bottom wall of the thermal insulation box member. A discharge side and a suction side of the cooling chamber correspond to lower sides of the cold air discharge port and cold air suction port in a state in which the hanging rails are supported on the support rails, and the pushup mechanism pushes up the only cooling box in the bottom wall direction in the state.

According to the present invention, the above-described invention further comprises the pushup mechanism comprising: the pair of hanging rails disposed on the opposite side upper portions of the cooling box; and the pair of support rails which are positioned on the opposite sides of the cold air discharge port and the cold air suction port and which are disposed on the bottom wall of the thermal insulation box member. The discharge side and the suction side of the cooling chamber correspond to the lower sides of the cold air discharge port and cold air suction port in the state in which the hanging rails are supported on the support rails, and the pushup mechanism pushes up the only cooling box in the bottom wall direction in the state. By this pushup mechanism, the cooling box can be pushed up toward the thermal insulation box member, and pressed onto the bottom wall side of the thermal insulation box member of the cooling box.

Especially, in the invention, the pair of hanging rails are disposed on the opposite side upper portions of the cooling box, and the hanging rails are supported on the support rails of the bottom wall of the thermal insulation box member. Therefore, the end portions of the hanging rails can be laid and slid on the support rails, and the attaching operation of the cooling box is facilitated.

Moreover, according to the cold storage of the present invention, in the above-described inventions, the thermal insulation box member comprises an inner box, an outer box, an insulating material filled between both the boxes and the like, openings are formed in bottom faces of the inner and outer boxes constituting the bottom wall of the thermal insulation box member, a passage member constituting the cold air discharge port and the cold air suction port between both the openings is disposed in the insulating material, an upper end of the passage member is allowed to abut on a downward flange formed on an opening edge of the inner box bottom face on the side of the insulating material, and a lower end of the passage member is allowed to abut on an upward flange formed on an opening edge of the outer box bottom face on a non-insulating-material-side.

According to the present invention, in the above-described inventions, the thermal insulation box member comprises the inner box, the outer box, the insulating material filled between both the boxes and the like. Moreover, the openings are formed in the bottom faces of the inner and outer boxes constituting the bottom wall of the thermal insulation box member. The passage member constituting the cold air discharge port and the cold air suction port between both the openings is disposed in the insulating material. The upper end of the passage member is allowed to abut on the downward flange formed on the opening edge of the inner box bottom face on the side of the insulating material, and the lower end of the passage member is allowed to abut on the upward flange formed on the opening edge of the outer box bottom face on the non-insulating-material-side. Therefore, water discharged from the storage chamber can smoothly flow into the cooling chamber via the cold air discharge port and cold air suction port along the passage member without being interrupted by the passage member disposed on the edge portions of the cold air discharge and suction ports.

Moreover, since draining can be performed by the passage member disposed in the cold air discharge and suction ports, the water discharged from the storage chamber can be smoothly treated.

Furthermore, in the cold storage of the present invention, in the above-described invention, the lower end of the passage member is attached to the upward flange from above.

According to the present invention, in the above-described inventions, since the lower end of the passage member is attached to the upward flange from above, a draining effect can be increased, and water immersion on the insulating material side can be prevented.

Moreover, with regard to the cold storage of the present invention, the above-described invention further comprises: an overflow port formed in the cooling box; and a drainboard disposed under the cooler, and the drainboard comprises a barrier having a predetermined water passing portion on a windward side of passed air by the blower.

According to the present invention, the above-described invention comprises: the overflow port formed in the cooling box; and the drainboard disposed under the cooler, and the drainboard comprises the barrier having the predetermined water passing portion on the windward side of passed air by the blower. Therefore, the water discharged from the storage chamber via the cold air discharge and suction ports can be smoothly passed downwards to the overflow port through the water passing portion of the barrier of the drainboard. Defrosted water generated in the cooler can be smoothly passed to the overflow port, and therefore a draining process can be smoothly performed.

Furthermore, since the barrier is formed in the drainboard, a disadvantage that a short cycle of cold air is caused under the cooler can be inhibited.

DETAILED DESCRIPTION OF THE PREFERRED EMBODIMENT

Figure 1:
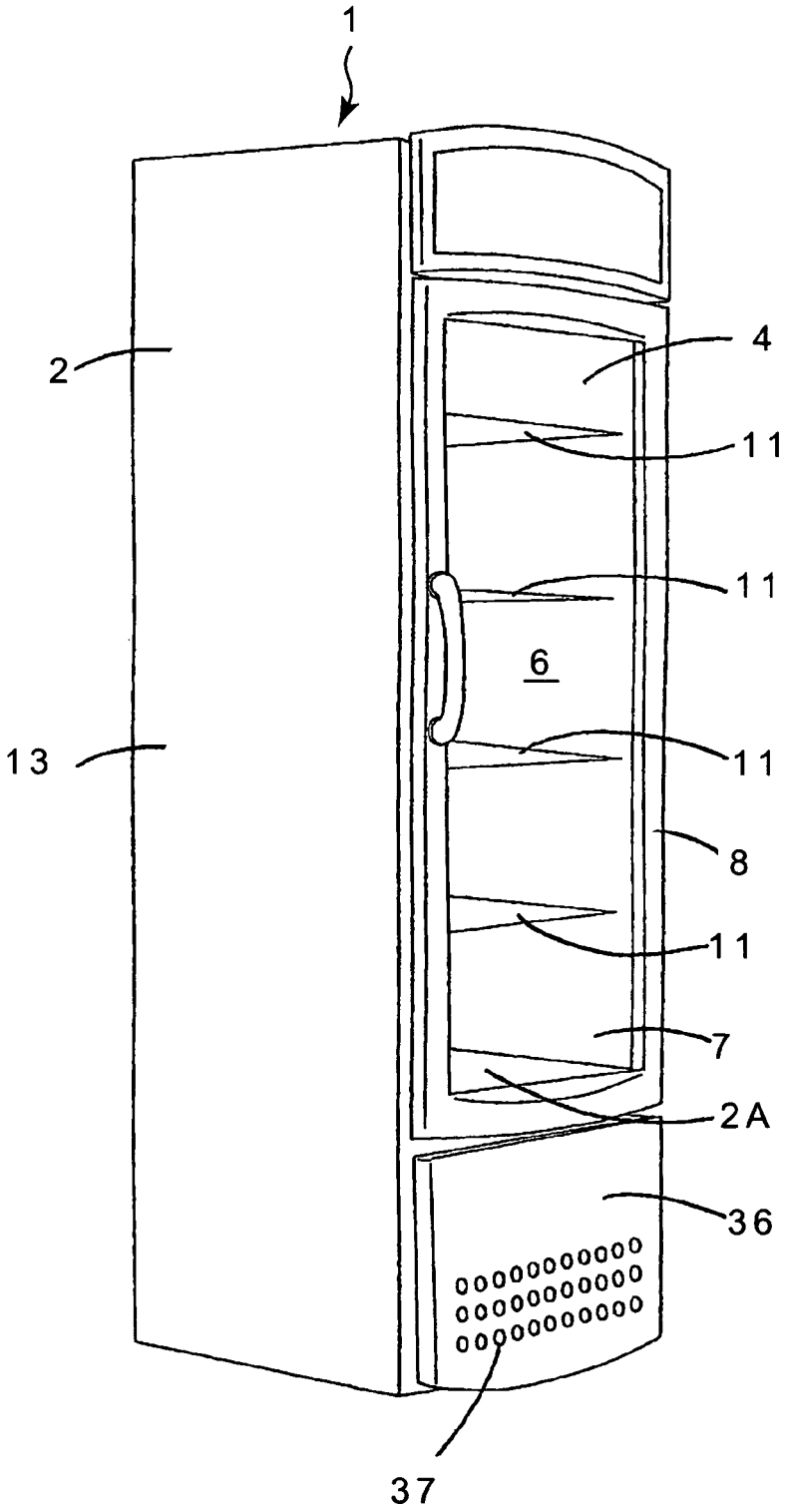
FIG. 1 is a perspective view of a cold storage.
Figure 2:
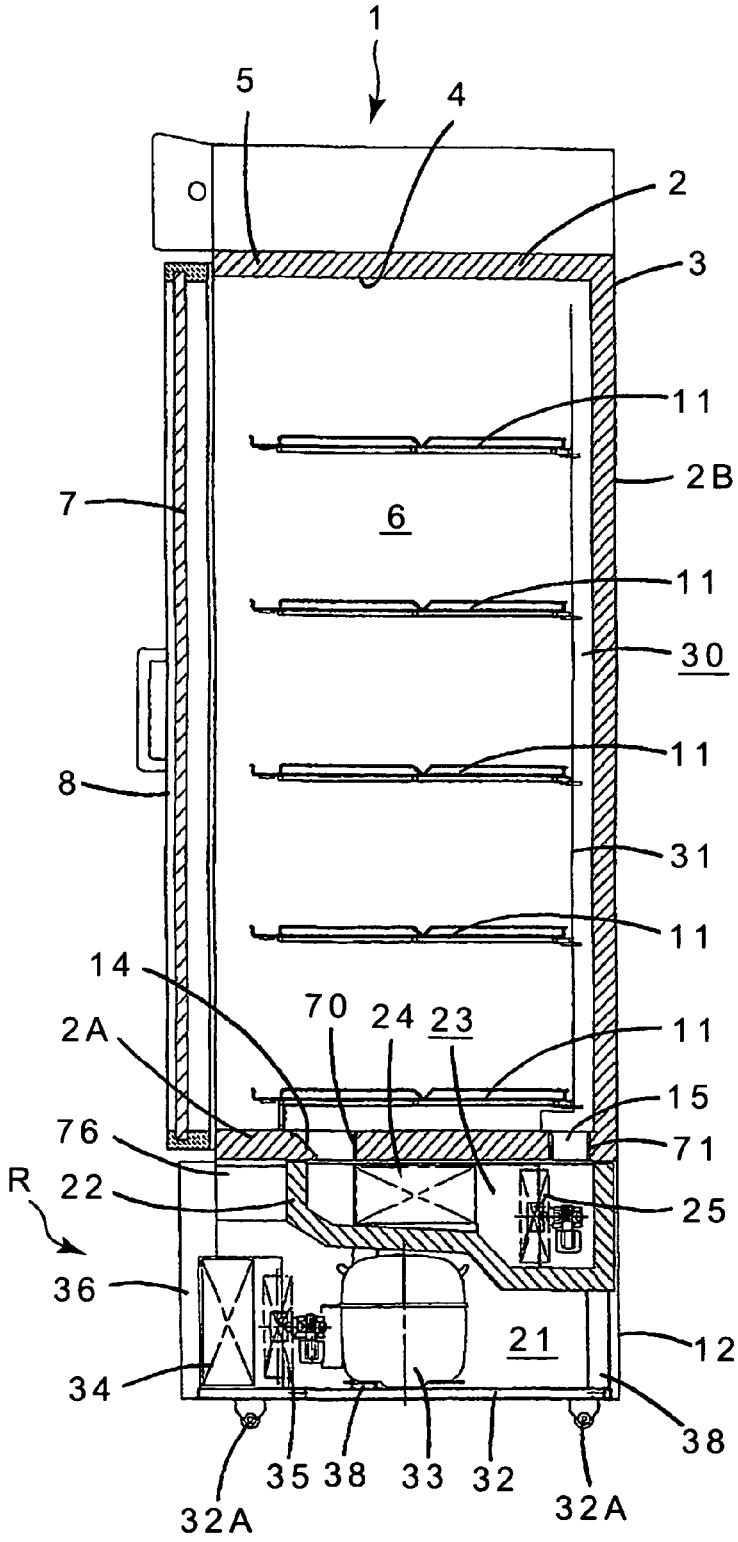
FIG. 2 is a vertical side view of the cold storage.

The present invention has been developed to solve conventional technique problems, and there is provided a cold storage in which a cooling box is attached to a bottom wall of a thermal insulation box member without any trouble, cold air circulation is constituted in such a manner that cold air which has exchanged heat with a cooler is discharged into a storage chamber by an air blower via a cold air discharge port, and sucked into a cooling chamber via a cold air suction port, and the inside of the storage chamber can be cooled. An embodiment of the present invention will be described hereinafter in detail with reference to the drawings.

In a cold storage 1 of an embodiment, a main body is constituted by a rectangular thermal insulation box member 2 whose front face is opened. The thermal insulation box member 2 comprises: an outer box 3 having an opening in the front face and formed of a steel plate; an inner box 4 having an opening in the front face; and an insulating material 5 foamed and filled between both the inner/outer boxes 3, 4. Moreover, a storage chamber 6 whose front face opens is formed in the thermal insulation box member 2, and the front-face opening of the storage chamber 6 is openably closed by a door 8 comprising glass 7 through which the inside is visible. The door 8 is an opening door whose one side end is rotatably supported on a side portion of the thermal insulation box member 2. A plurality of stages of shelves 11 . . . on which food and the like are laid are extended in the storage chamber 6.

A base leg angle 12 having a predetermined height is attached to the bottom face of the thermal insulation box member 2, and opposite side faces of the base leg angle 12 are covered with a decorative panel 13 together with opposite side faces of the thermal insulation box member 2. Accordingly, a mechanical chamber 21 is formed under the thermal insulation box member 2. A cold air suction port 14 and a cold air discharge port 15 are formed forwards/backwards through the insulating material 5 in a bottom wall 2A of the thermal insulation box member 2.

Figure 4:
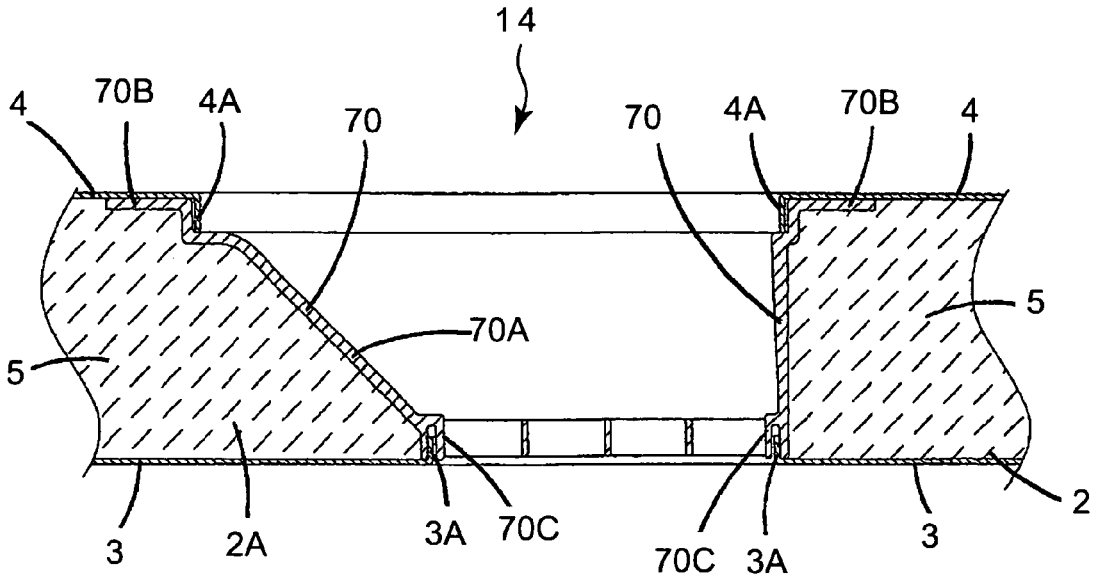
FIG. 4 is an enlarged sectional view of a cold air suction port.
Figure 5:
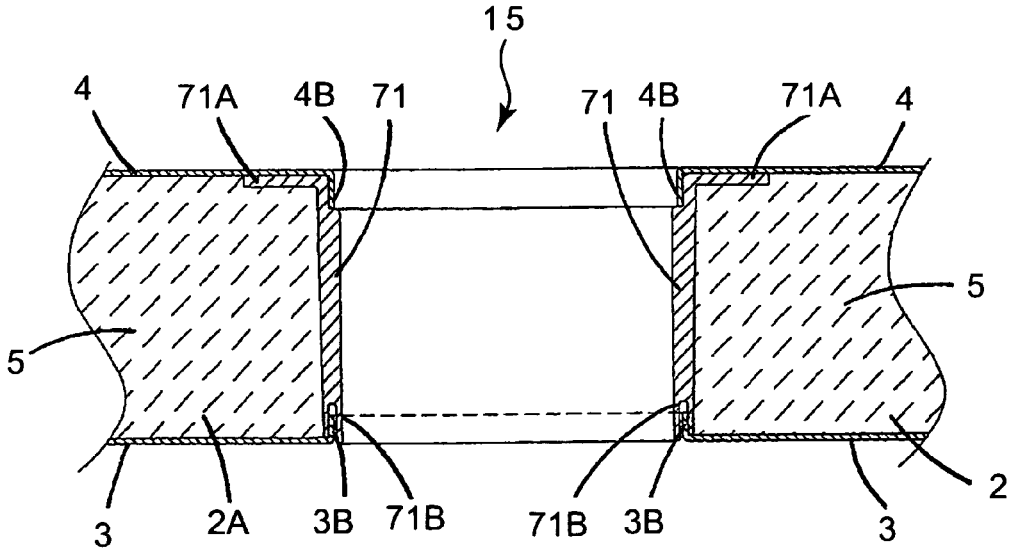
FIG. 5 is an enlarged sectional view of a cold air discharge port.

Here, constitutions of the cold air suction port 14 and the cold air discharge port 15 will be described with reference to FIGS. 4 and 5. FIG. 4 shows an enlarged sectional view of the cold air suction port 14, and FIG. 5 shows an enlarged sectional view of the cold air discharge port 15. As shown in FIG. 4, the cold air suction port 14 is constituted by attaching a passage member 70 constituting the cold air suction port 14 to an opening formed in the bottom wall 2A of the thermal insulation box member 2. A front part of the passage member 70 constituting a front edge of the cold air suction port 14 is tilted low toward the inside to form a tilted wall 70A.

A downward flange 4A is formed on an opening edge of the bottom face of the inner box 4 of the thermal insulation box member 2 in which the cold air suction port 14 is formed, and an upward flange 3A is formed on the opening edge of the bottom face of the outer box 3 of the thermal insulation box member 2 in which the cold air suction port 14 is formed. On the other hand, an upper end 70B of the passage member 70 attached to the cold air suction port 14 is disposed to abut on the downward flange 4A formed on the inner box 4 on an insulating material 5 side. A lower end 70C of the passage member 70 has a substantially U-shaped section, and is disposed to cover the upward flange 3A formed on the outer box 3 from above.

Accordingly, as to the cold air suction port 14, the upper end 70B of the passage member 70 is covered with the flange 4A of the opening edge of the inner box 4. In the bottom wall 2A of the thermal insulation box member 2, a water flow path of dew condensation is formed, without any barrier, from the opening edge of the inner box 4 over corresponding passage member 70 and substantially the U-shaped section formed on lower end 70C on a non insulating material 5 side. Therefore, water discharged from the storage chamber 6 can smoothly flow into a cooling chamber 23 described later along the passage member 70 via the cold air suction port 14 without being interrupted by the passage member 70 disposed on the edge portion of the cold air suction port 14. Moreover, since defrosted water can be drained by the passage member 70 disposed in the cold air suction port 14, the water discharged from the storage chamber 6 can be smoothly disposed of.

On the other hand, as shown in FIG. 5, the cold air discharge port 15 is constituted by attaching a passage member 71 constituting the cold air discharge port 15 to an opening formed in the bottom wall 2A of the thermal insulation box member 2. A downward flange 4B is formed on the opening edge of the bottom face of the inner box 4 of the thermal insulation box member 2 in which the cold air discharge port 15 is formed, and an upward flange 3B is formed on the opening edge of the bottom face of the outer box 3 of the thermal insulation box member 2 in which the cold air discharge port 15 is formed. On the other hand, an upper end 71A of the passage member 71 attached to the cold air discharge port 15 is disposed to abut on the downward flange 4B formed on the inner box 4 on an insulating material 5 side. A lower end 71B of the passage member 71 has a substantially U-shaped section, and is disposed to cover the upward flange 3B formed on the outer box 3 from above.

Accordingly, as to the cold air discharge port 15, the upper end 71A of the passage member 71 is covered with the flange 4B of the opening edge of the inner box 4. In the bottom wall 2A of the thermal insulation box member 2, a water flow path of dew condensation is formed, without any barrier, from the opening edge of the inner box 4 over the passage member 71 and substantially the U-shaped section formed on the lower end 71B on a non insulating material 5 side. Therefore, water discharged from the storage chamber 6 can smoothly flow into the cooling chamber 23 described later along the passage member 71 via the cold air discharge port 15 without being interrupted by the passage member 71 disposed on the edge portion of the cold air discharge port 15. Moreover, since defrosted water can be drained by the passage member 71 disposed in the cold air discharge port 15, the water discharged from the storage chamber 6 can be smoothly disposed of.

Moreover, since the lower ends of the respective passage members 70, 71 cover the upward flanges 3A, 3B of the inner box 4 constituting the thermal insulation box member 2, a draining effect can be increased, and water immersion on the insulating material 5 side can be prevented. It is to be noted that the respective passage members 70, 71 are attached to the openings, and integrally formed at the time of foaming/filling the insulating material 5 during the forming of the thermal insulation box member 2.

On the other hand, a cooling box 22 having an opening in an upper face is disposed to abut on the lower face of the bottom wall 2A of the thermal insulation box member 2 constituting the ceiling of the mechanical chamber 21. The cooling chamber 23 is formed inside the cooling box 22, a cooler 24 constituting a cooling device is disposed in the chamber, and an air blower 25 for the cooler is disposed behind the cooler 24.

Figure 8:
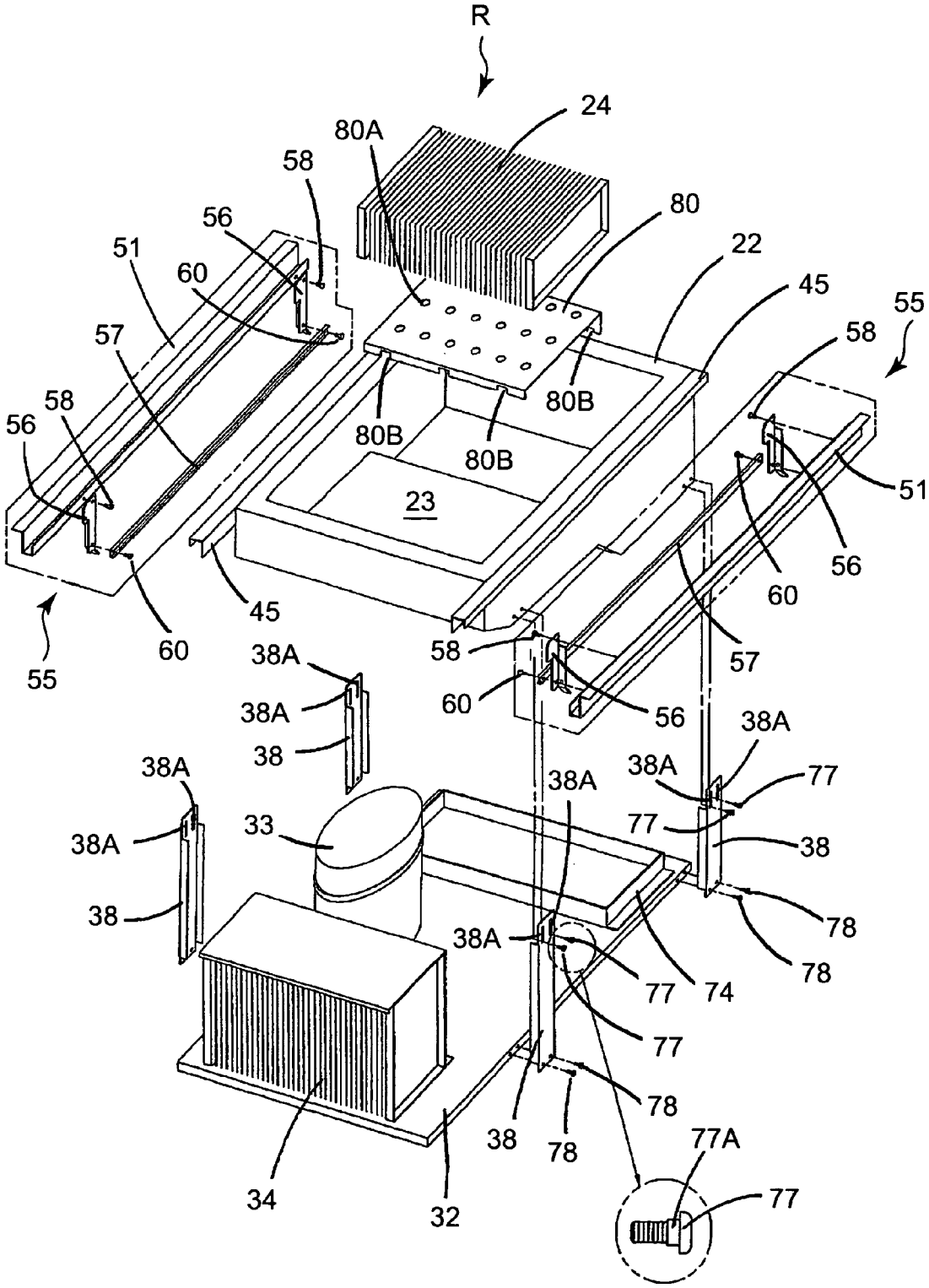
FIG. 8 is an exploded perspective view of the cooling unit.

Here, a drainboard 80 is disposed under the cooler 24 as shown in an exploded perspective view of a cooling unit R of FIG. 8. This drainboard 80 has a substantially U-shaped section opened downwards, and a plurality of drain holes 80A for discharging defrosted water from the cooler 24 downwards are formed in the upper face of the drainboard. Moreover, the front and rear faces of the drainboard 80 are positioned on a windward side of the air passed by the air blower 25 for the cooler, and formed as barriers in which a plurality of water passing portions 80B are formed.

Figure 3:
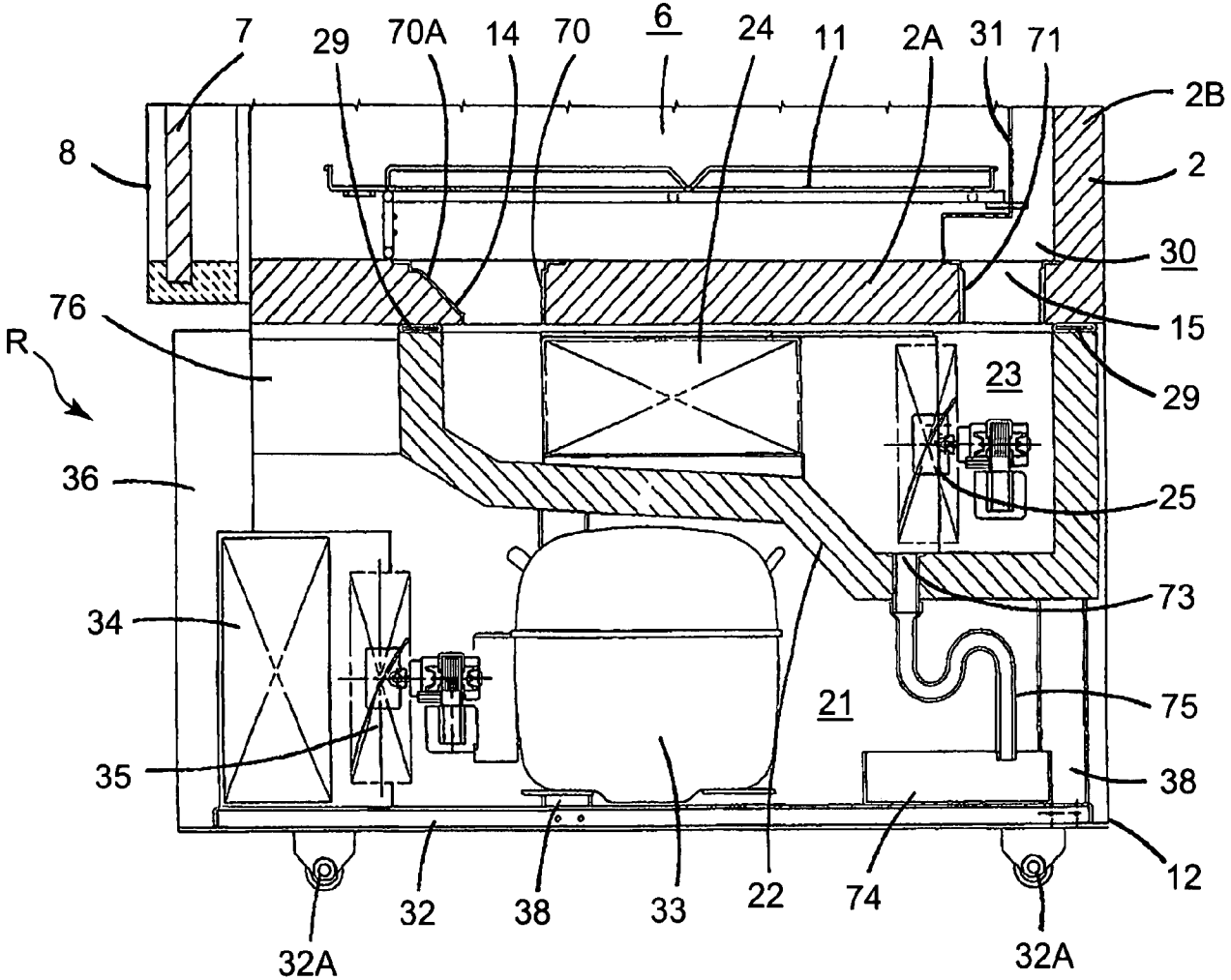
FIG. 3 is an enlarged longitudinal side view of a lower part of FIG. 2.

Moreover, as shown in FIG. 3, an overflow port 73 is formed in the bottom wall of the cooling box 22, and the overflow port 73 is connected to a water discharge hose 75 whose one end is connected to an evaporation tray 74. Therefore, dew condensation which has flown downwards into the cooling box 22 from the storage chamber 6, and dew condensation generated in the cooler 24 are supplied to the evaporation tray 74 via the overflow port 73 and the water discharge hose 75, and evaporated.

Accordingly, drainage which has flown into the cooling chamber 23 from the storage chamber 6 via the cold air discharge port 15 and the cold air suction port 14 can smoothly flow downwards into the overflow port 73 through the water passing portions 80B of the barriers of the drainboard 80 without being brought into contact with the cooler 24. The defrosted water generated in the cooler 24 can also be smoothly passed to the overflow port 73, and a draining process can be smoothly performed.

Furthermore, since the front and rear faces of the drainboard 80 constitute the barriers of a cold air flow path extending under the cooler 24, a disadvantage that the short cycle of the cold air is generated under the cooler 24 can be inhibited.

Figure 6:
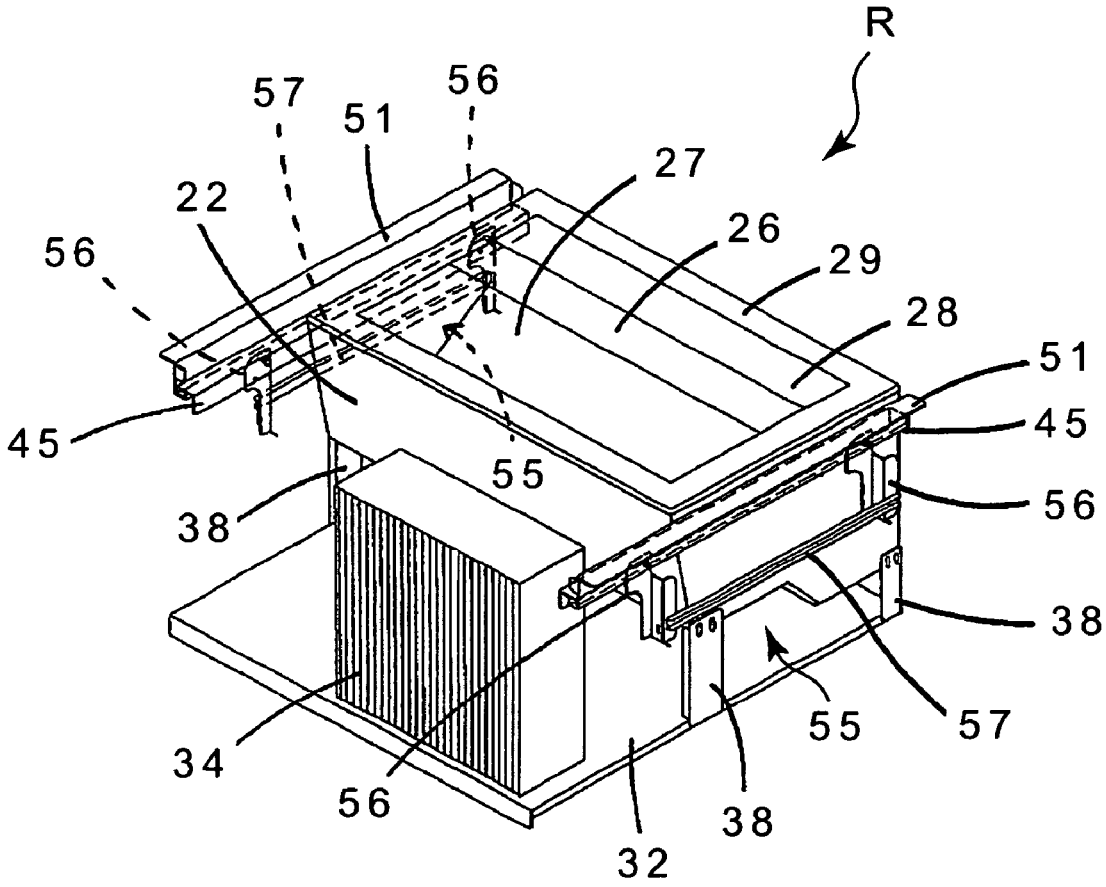
FIG. 6 is a perspective view of a cooling unit.
Figure 7:
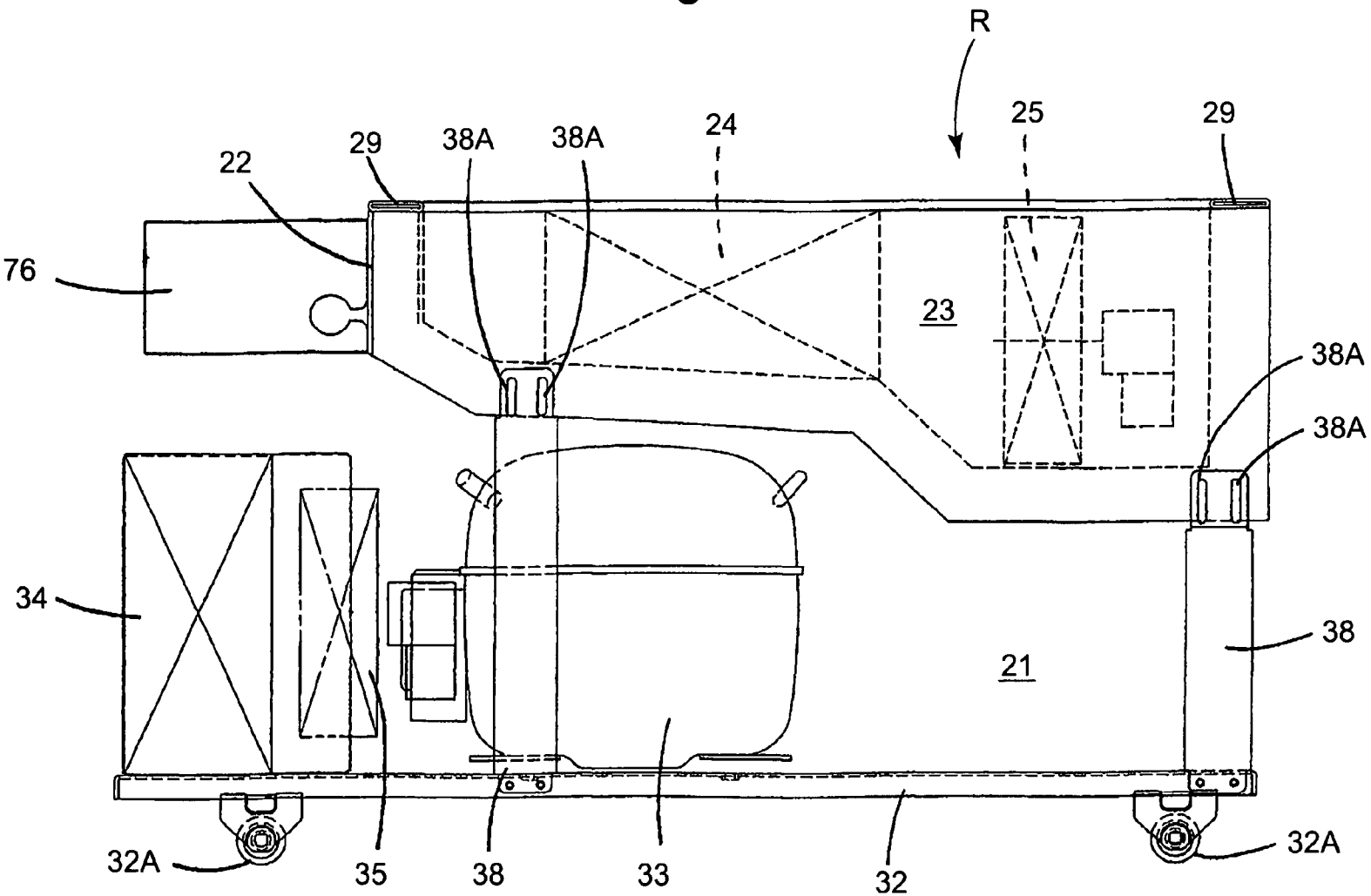
FIG. 7 is a longitudinal side view of the cooling unit.

A cold air suction port 27 and a cold air discharge port 28 on a cooling box 22 side are formed in the upper face opening of the cooling box 22 by a partition plate 26 as shown in a perspective view of the cooling unit R of FIG. 6. These cold air suction port 27 and cold air discharge port 28 face the cold air suction port 14 and cold air discharge port 15 formed in the bottom wall 2A of the thermal insulation box member 2. A sealing material 29 which closely adheres to and abuts on the lower face of the bottom wall 2A of the thermal insulation box member 2 is attached to an opening edge of the cooling box 22. It is to be noted that a mechanism to closely attach and fix the upper face of the cooling box 22 to the lower face of the bottom wall 2A of the thermal insulation box member 2 will be described later in detail.

On the other hand, a partition plate 31 constituting a duct 30 which connects the cold air discharge port 15 formed in the bottom wall 2A to the upper part of the storage chamber 6 is attached to the inside of a back wall 2B of the thermal insulation box member 2. A plurality of openings (not shown) for supplying the cold air discharged from the air blower 25 for the cooler are formed in the partition plate 31. Accordingly, the cold air is effectively supplied into the storage chamber 6. It is to be noted that engaging portions engaged with the shelves 11 may be formed on the partition plate 31.

On the other hand, an attachment base 32 constituting a bottom part of the cooling unit R is stored in the mechanical chamber 21. A compressor 33, a condenser 34, and an air blower 35 for the condenser constituting a cooling device together with the cooler 24, a control box 76 and the like are disposed on the attachment base 32. Casters 32A are attached to four corners of the attachment base 32. It is to be noted that the casters 32A are shown only in FIGS. 2, 3, 7, 9. A openable panel 36 is attached to the front face of the mechanical chamber 21, and shields the mechanical chamber 21. It is to be noted that a plurality of vent holes 37 are formed in the panel 36 facing a front part of the condenser 34.

Figure 9:
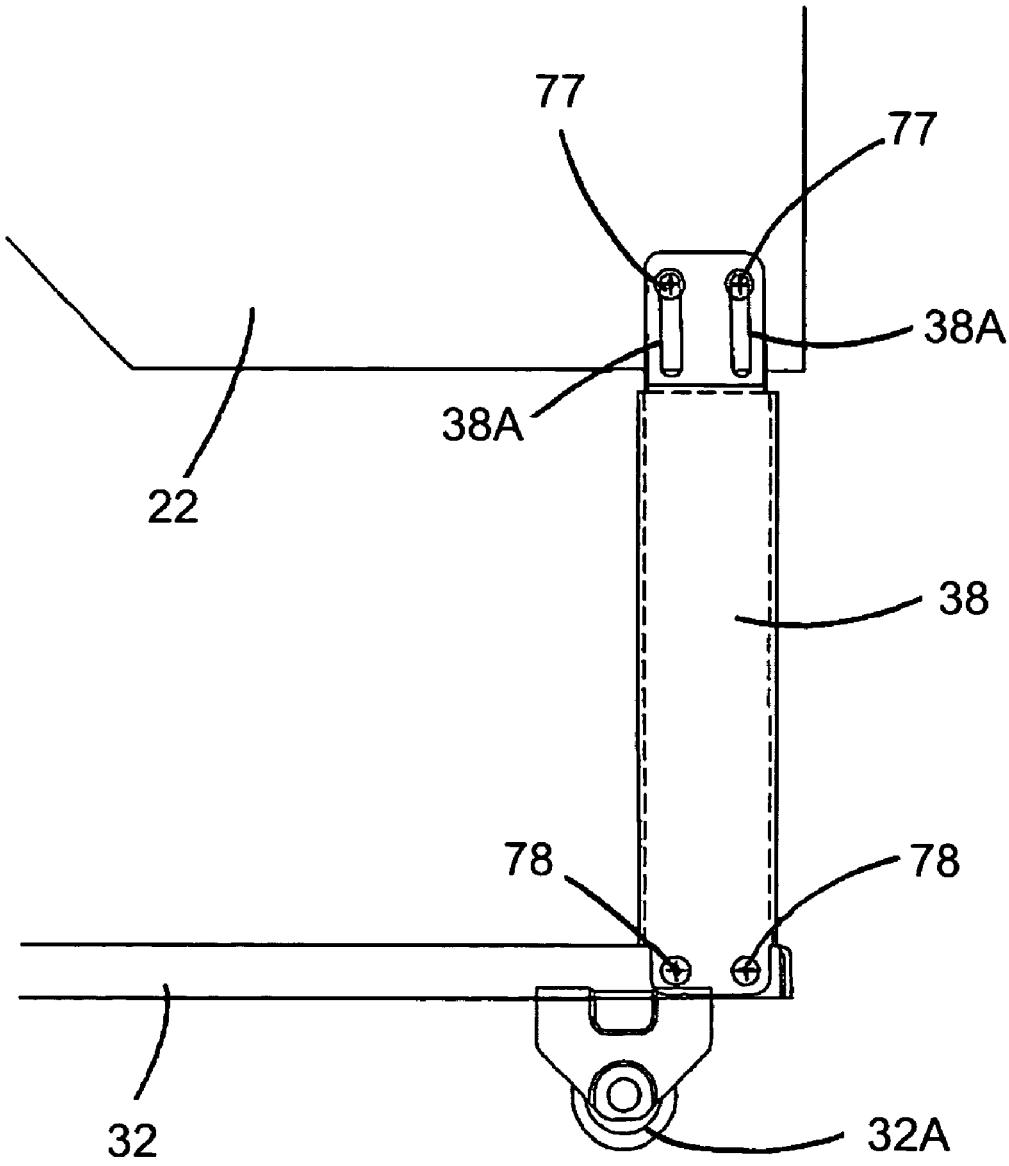
FIG. 9 is a partially enlarged side view of the cooling unit.

Here, the cooler 24 in the cooling box 22 is connected to the compressor 33 or the condenser 34 on the attachment base 32 via a refrigerant piping to constitute a known refrigerant circuit. The cooling box 22 is detachably held by cooling box support members 38 . . . disposed in positions corresponding to four corners of the lower face of the cooling box 22. As shown in FIGS. 8 and 9, long holes 38A, 38A vertically extending are formed in an upper end of each cooling box support member 3, and attached to a lower part of the cooling box 22 by adjustment screws 77 on which buffer portions 77A are formed in such a manner as to be movable to upper/lower positions. Attachment holes 38B, 38B are formed in the lower end of the cooling box support member 38, and the member is fixed to the attachment base 32 via screws 78. Accordingly, the cooling unit R comprising the cooling box 22, cooler 24, air blower 25 for the cooler, compressor 33, condenser 34 and the like is detachably stored together with the attachment base 32 in the mechanical chamber 21, and is detachable from the thermal insulation box member 2. The cooling box 22 is movable to the upper/lower positions in a range of the long hole 38A formed in the cooling box support member 38 with respect to the attachment base 32.

Figure 10:
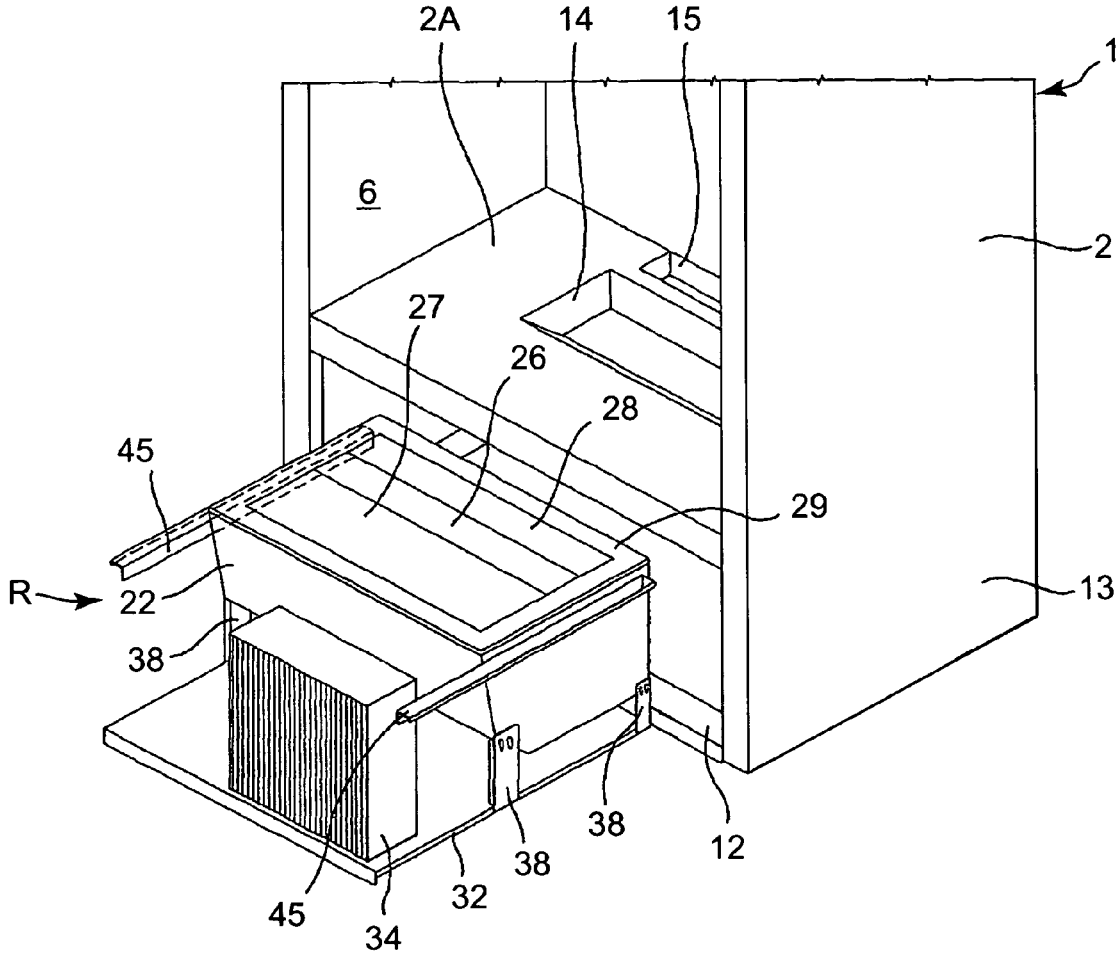
FIG. 10 is a partially enlarged perspective view of the lower part of the cold storage.
Figure 11:
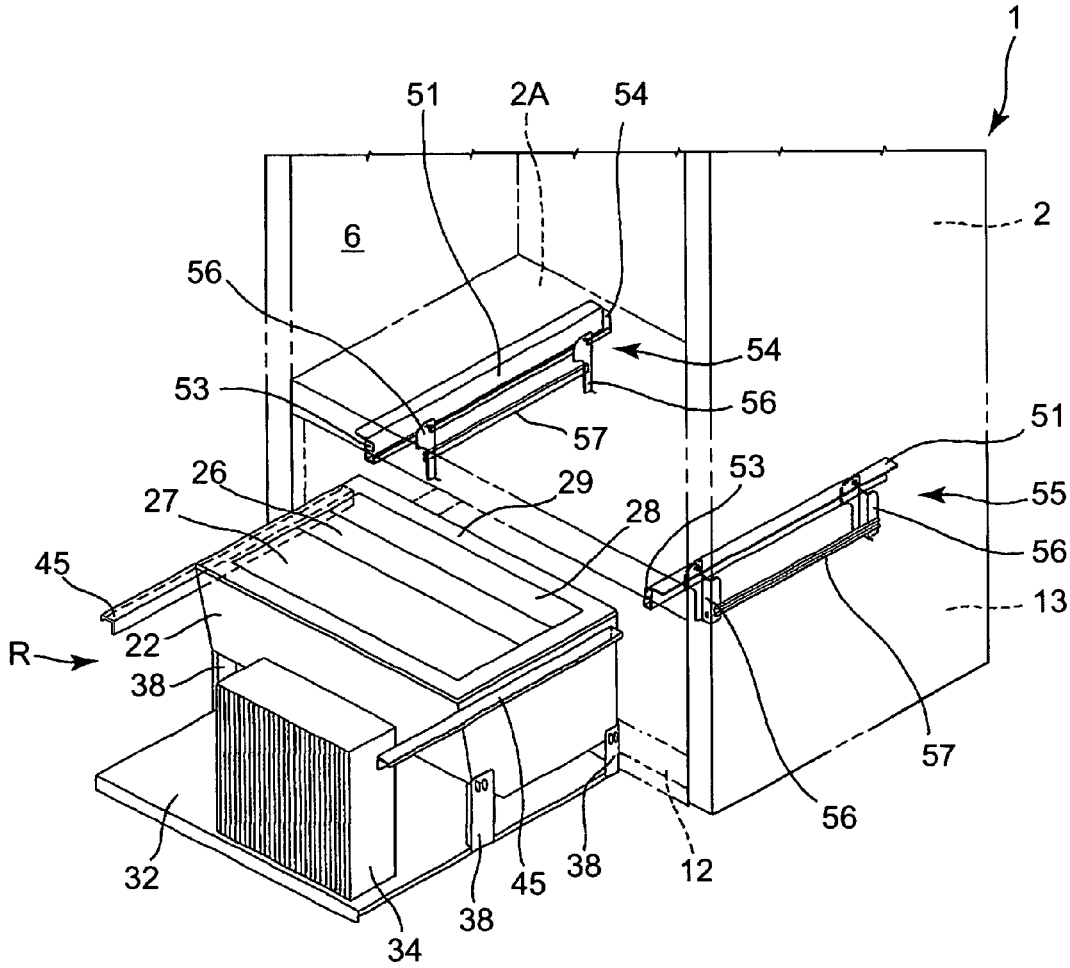
FIG. 11 is a perspective view of a bottom wall of FIG. 10.
Figure 12:
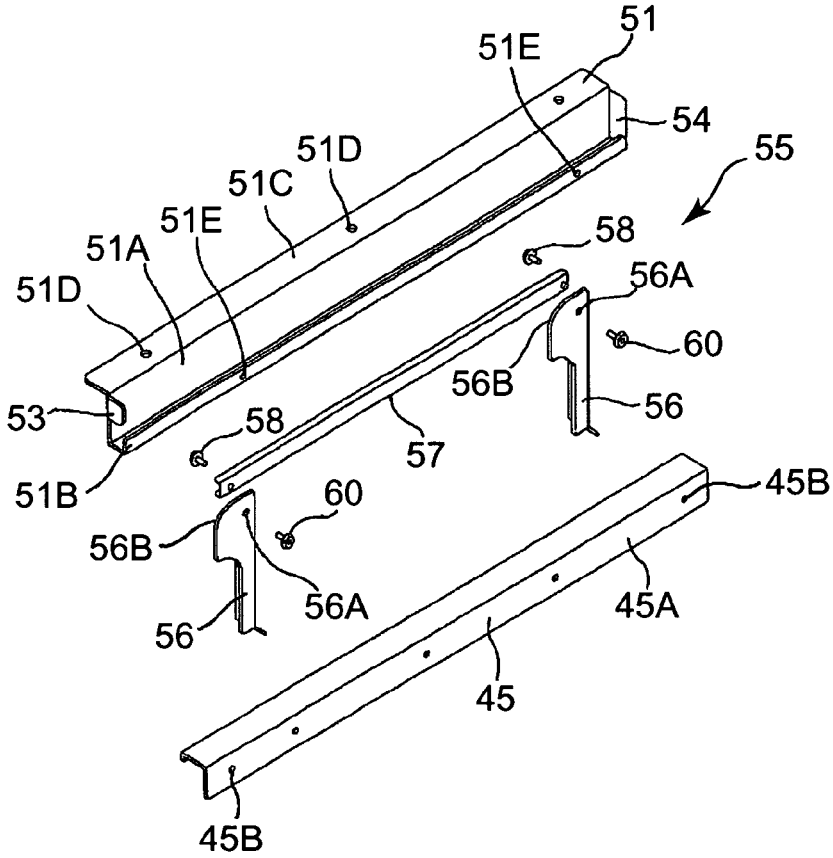
FIG. 12 is a perspective view of closely attaching/fixing mechanism constituting components.
Figure 13:
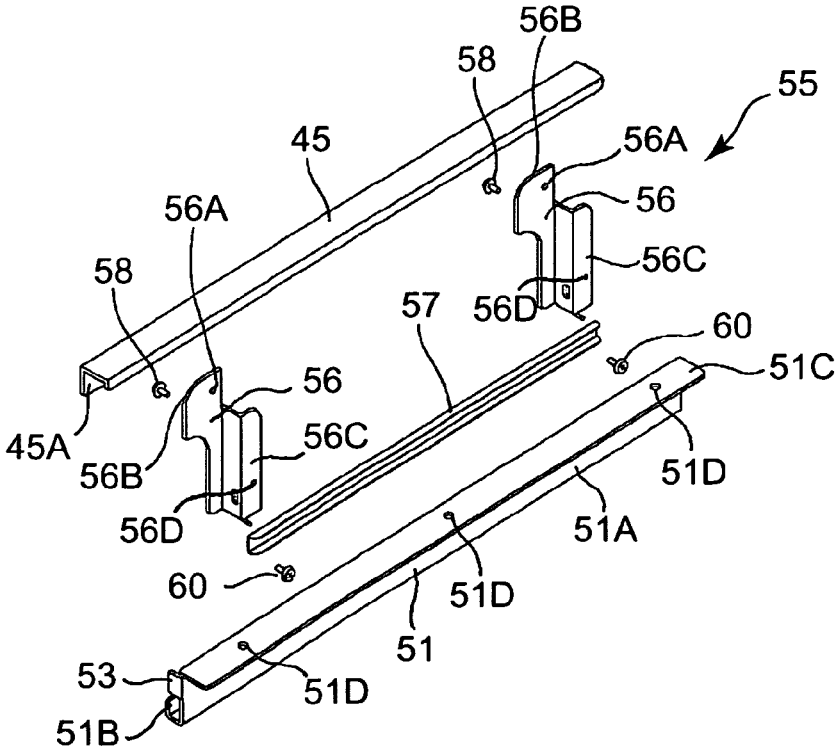
FIG. 13 is a perspective view of FIG. 12 viewed from a different direction.
Figure 14:
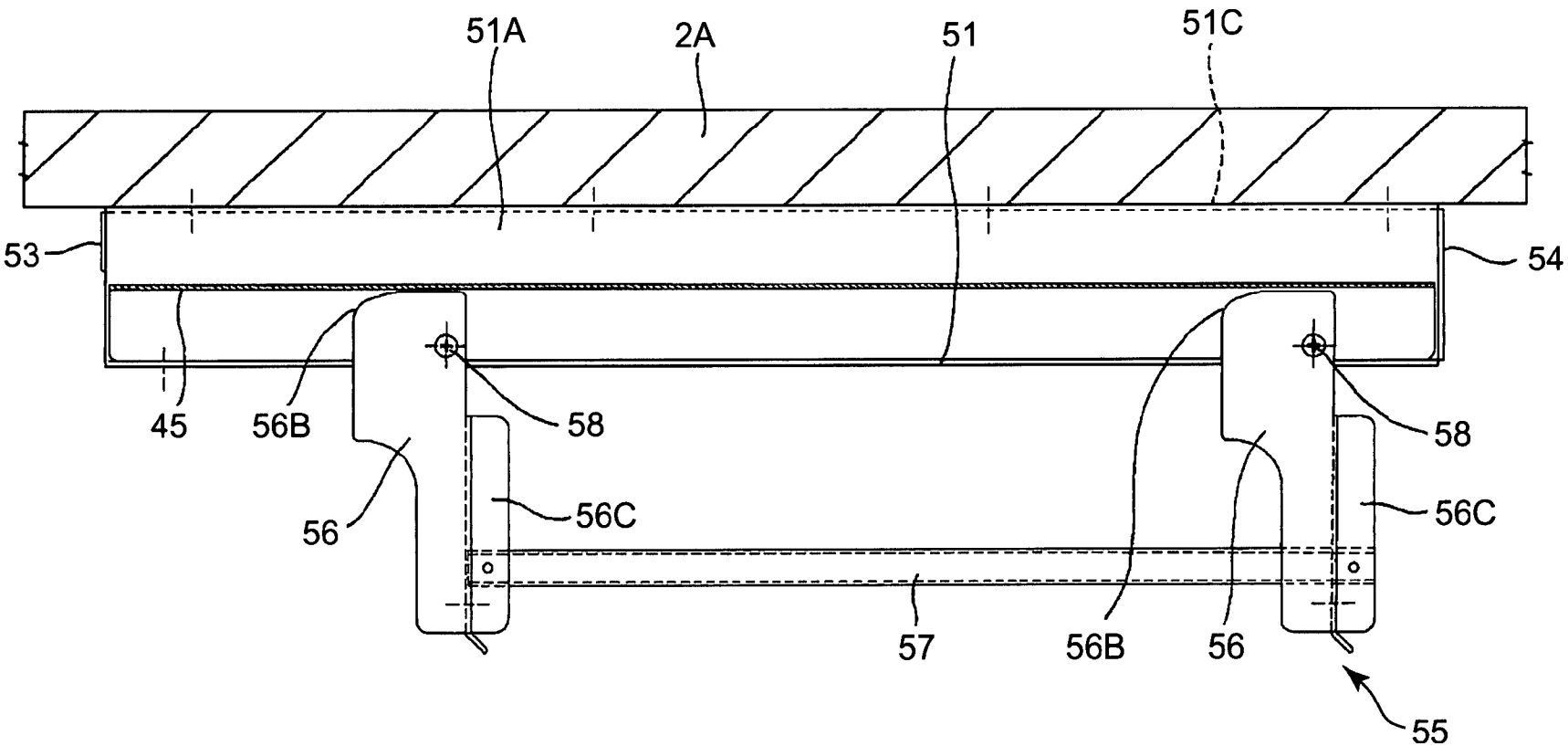
FIG. 14 is a partially enlarged side view of a state in which a pushup mechanism is lowered.
Figure 15:
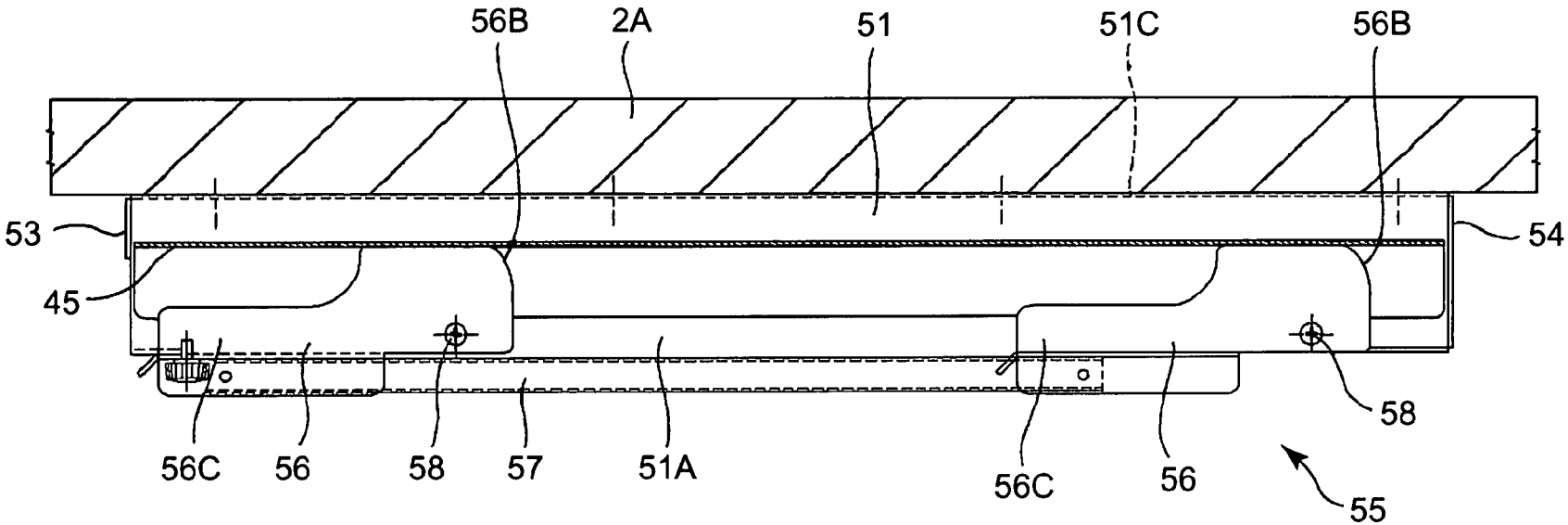
FIG. 15 is a partially enlarged side view of a state in which a pushup mechanism is pushed up.
Figure 17:
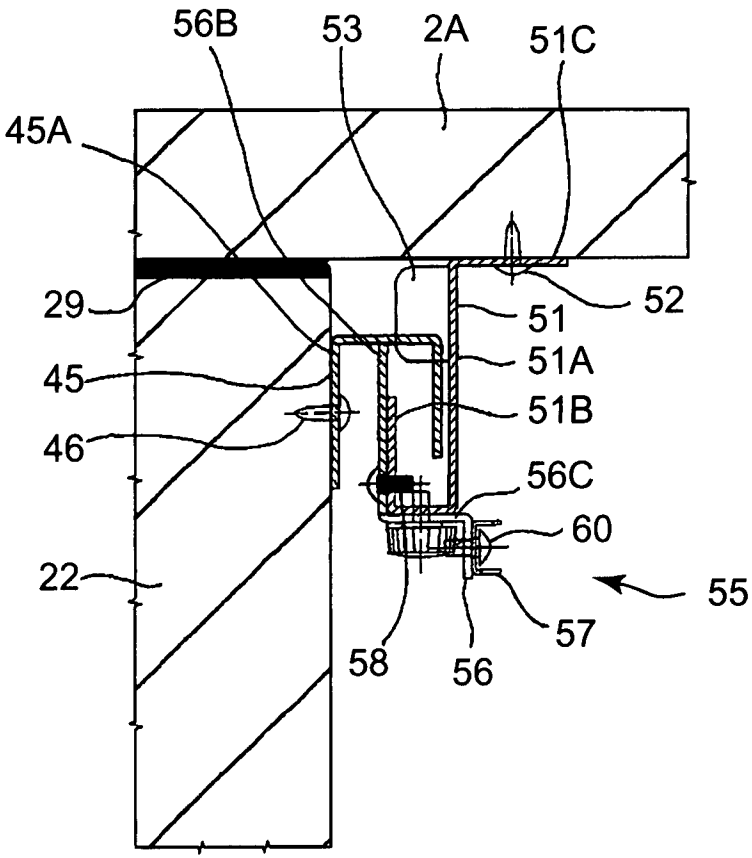
FIG. 17 is a longitudinal front view of FIG. 15.
Figure 16:
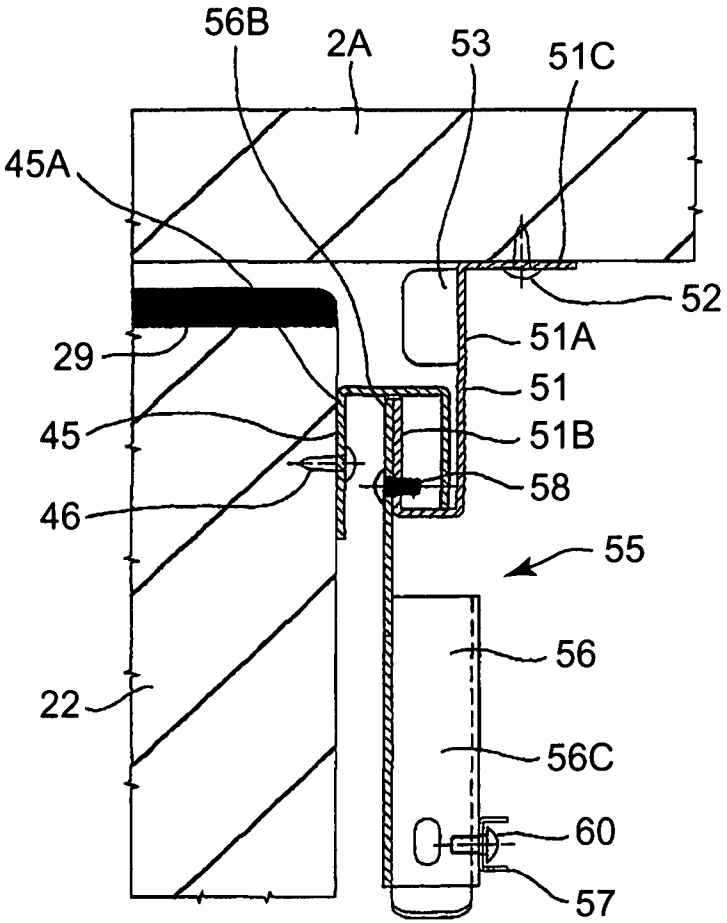
FIG. 16 is a longitudinal front view of FIG. 14.
Figure 18:
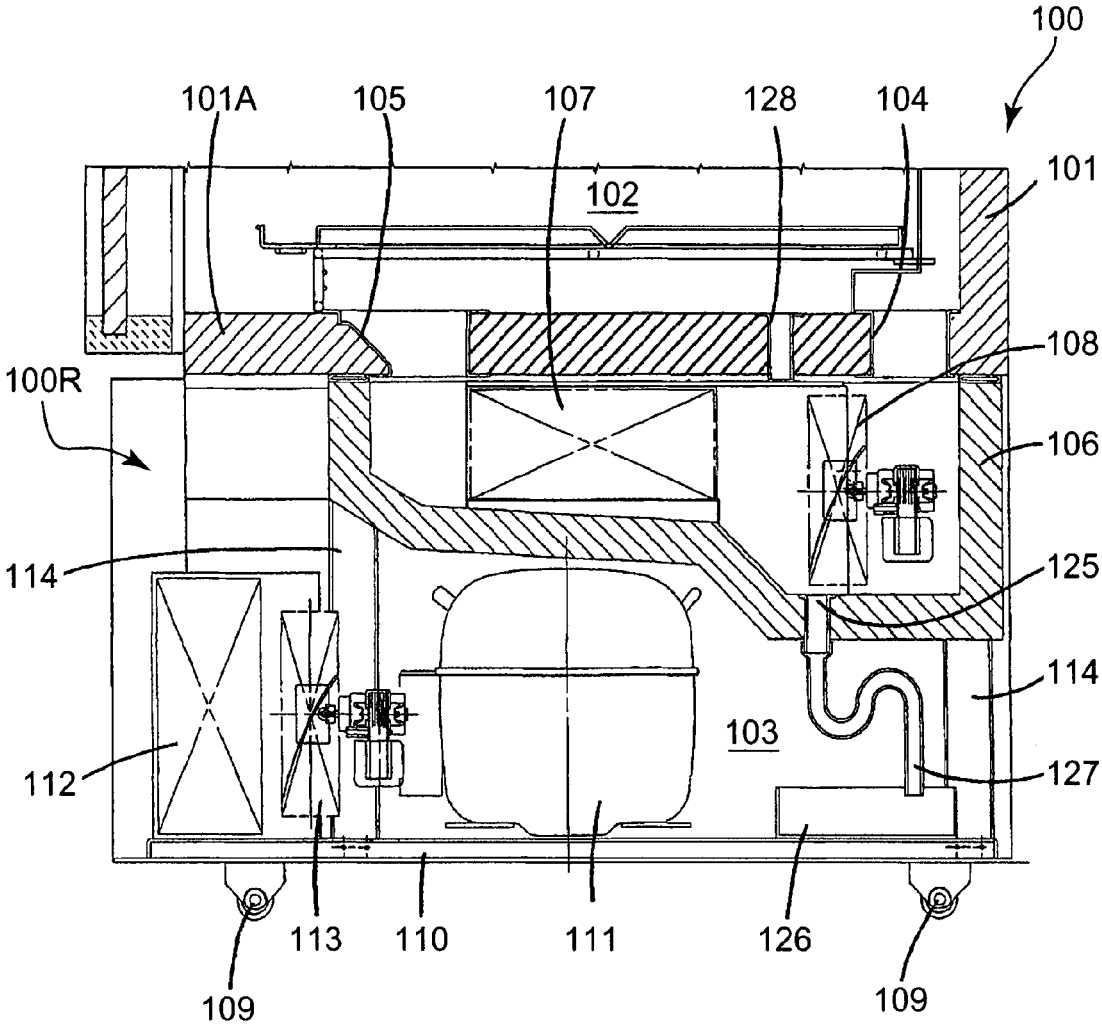
FIG. 18 RELATED ART
FIG. 18 is an enlarged vertical side view of a lower part of a conventional cold storage.
Figure 19:
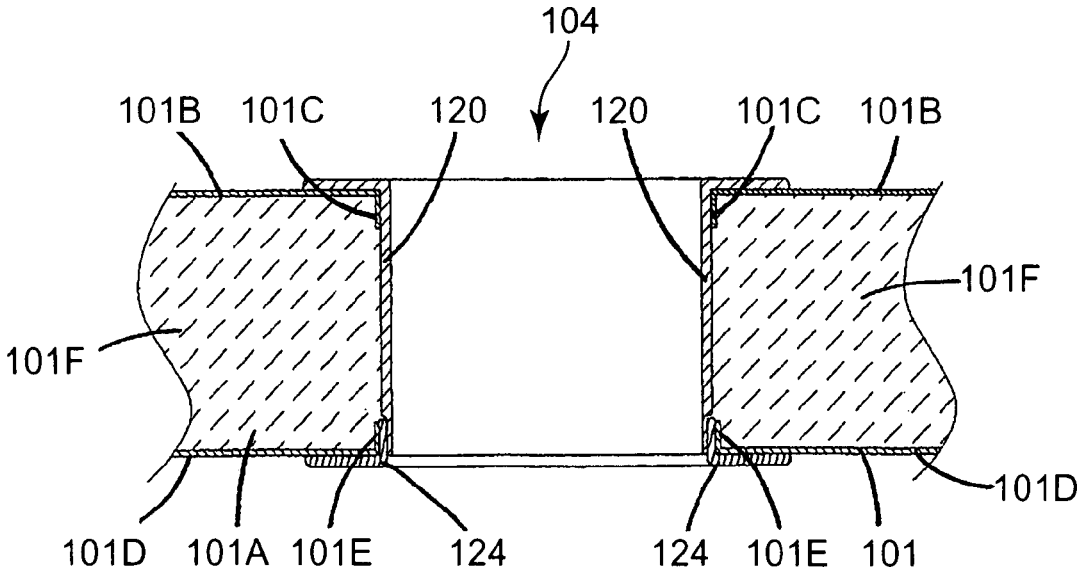
FIG. 19 RELATED ART
FIG. 19 is an enlarged sectional view of a cold air discharge port of FIG. 18.
Figure 20:
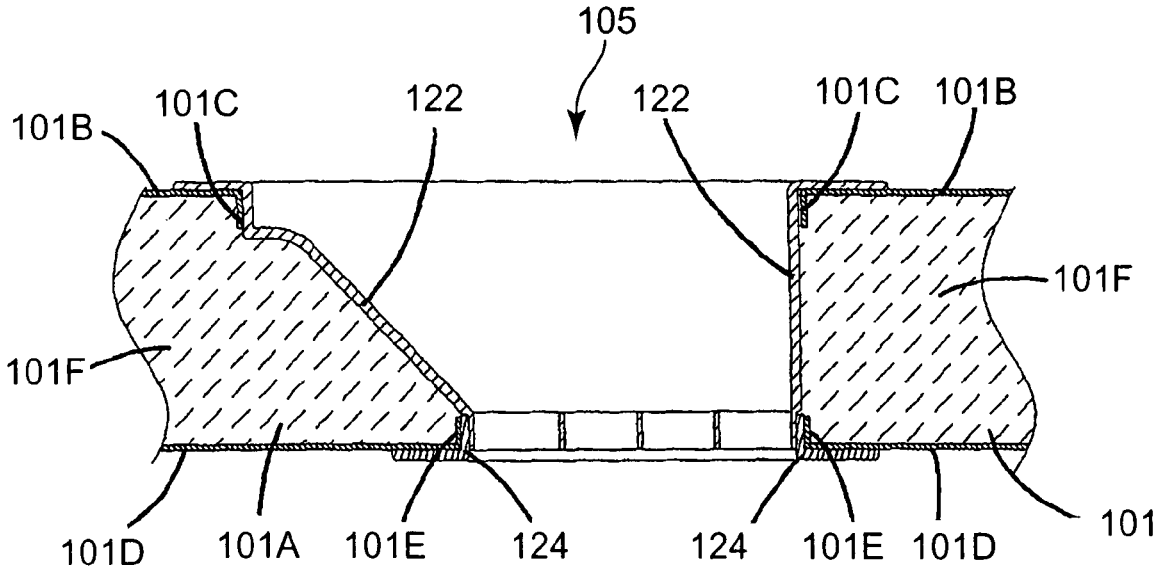
FIG. 20 RELATED ART
FIG. 20 is an enlarged sectional view of a cold air suction port of FIG. 18.

Next, the closely attaching/fixing mechanism of the cooling box 22 to the lower face of the bottom wall 2A of the thermal insulation box member 2 will be described with reference to FIGS. 10 to 17. FIG. 10 is a partially enlarged perspective view of the lower part of the cold storage 1, FIG. 11 is a perspective view of the bottom wall 2A of FIG. 10, FIG. 12 is a perspective view of closely attaching/fixing mechanism constituting components, FIG. 13 is a perspective view of FIG. 12 viewed from a different direction, and FIG. 14 is a partially enlarged side view of a state in which a pushup mechanism 55 is lowered. FIG. 15 is a partially enlarged side view of a state in which the pushup mechanism 55 is pushed up, FIG. 16 is a longitudinal front view of FIG. 14, and FIG. 17 is a longitudinal front view of FIG. 15.

The closely attaching/fixing mechanism of the cooling box 22 to the lower face of the bottom wall 2A comprises a pair of hanging rails 45, 45, a pair of support rails 51, 51, and a pushup mechanism 55. The hanging rails 45, 45 are rail members fixed to opposite side upper parts of the cooling unit R, that is, opposite side upper parts of the cooling box 22, and each rails has a substantially U-shaped section opened downwards as shown in FIG. 12. A plurality of screw holes 45B are formed in a side face 45A of the hanging rail 45 positioned on the side of the cooling box 22, and the hanging rail 45 is fixed to the cooling box 22 by a screw member 46 (shown only in FIGS. 16, 17).

The support rails 51, 51 are rail members which are positioned on the opposite sides of the cold air suction port 14 and cold air discharge port 15 and which are fixed to the lower face of the bottom wall 2A of the thermal insulation box member 2, and each rail has a substantially U-shaped section opened upwards as shown in FIG. 12. Furthermore, an upper end of a side face 51A of the support rails 51 position on the side opposite to the cooling box 22 is formed to be higher than the upper end of a side face 51B positioned on the side of the cooling box 22 by a predetermined dimension, and an attachment face 51C bent outwards substantially at right angles is formed. A plurality of screw holes 51D are formed in the attachment face 51C, and the support rail 51 is fixed to the lower face of the bottom wall 2A of the thermal insulation box member 2 via a screw member 52 (shown only in FIGS. 16, 17). At this time, the support rails 51, 51 are attached in such a manner that the cold air suction port 27 and the cold air discharge port 28 of the cooling chamber 23 face lower sides of the cold air suction port 14 and cold air discharge port 15 of the storage chamber 6 in a state in which the hanging rails 45, 45 are supported.

Moreover, a plurality of screw holes for attaching the pushup mechanism 55 are formed. In the present embodiment, two screw holes 51E are formed in front/rear end portions of the side face 51B positioned on the cooling box 22 side. Furthermore, stoppers 53, 54 are formed from the side face 51A toward the side face 51B in front and rear ends of the support rails 51.

The pushup mechanism 55 in the present embodiment comprises two pushup arms 56, 56 attached to the front and rear ends of each support rails 51, and a link arm 57 for rotating together the front/rear attached pushup arms 56, 56. The pushup arm 56 is an arm member having a predetermined length, and a shaft hole 56A into which a rotary shaft 58 is insertable is formed in an upper end portion. The shaft hole 56A is rotatably fastened together with the screw hole 51E formed in the support rail 51 and the rotary shaft 58.

Moreover, a cam face 56B rotatable centering on the rotary shaft 58 is formed in the upper end portion of the pushup arm 56, and the cam face 56B abuts on the upper wall of the hanging rail 45 in a state in which the hanging rail 45 is supported on the support rail 51. The cam face 56B is formed in such a manner that a radius from the rotary shaft 58 enlarges, when the pushup arm 56 is rotated forwards centering on the rotary shaft 58. Therefore, as shown in FIGS. 14 and 16, each pushup arm 56 is brought into a vertical state, and the hanging rail 45 is supported on the support rail 51. Thereafter, the pushup arm 56 is rotated forwards centering on the rotary shaft 58, and brought into a horizontal state. Then, as shown in FIGS. 15 and 17, the hanging rail 45 which abuts on the cam face 56B is pushed upwards by a radius increase of the cam face 56B.

It is to be noted that horizontal faces are formed on the upper end and front face of the pushup arm 56 constituting the cam face 56B, and are capable of stably holding the hanging rail 45, when the pushup arm 56 is brought into substantially vertical and horizontal states. That is, when the pushup arm 56 is brought into the substantially horizontal state, the hanging rail 45 is detached from the support rail 51, and held only by the cam face 56B of the 56. The hanging rail 45 can be stably held while the rails is pushed up.

Moreover, as shown in FIG. 13, the rear end of the pushup arm 56 is bent substantially vertically, for example, on a hanging rail 45 side, and thereafter a link arm attachment portion 56C bent substantially vertically is formed further rearwards. A screw hole 56D is formed in the link arm attachment portion 56C, and the link arm 57 is fixed extending between the link arm attachment portions 56C, 56C of the front/rear pushup arms 56, 56 by screw members 60, 60.

Accordingly, since the front/rear pushup arms 56, 56 are connected to each other via the link arm 57, it is possible to operate the rear pushup arm 56 smoothly together by the operation of the front pushup arm 56.

By the above-described constitution, a fixing operation of the cooling box 22 will be described. First, the cooling unit R is stored together with the attachment base 32 in the mechanical chamber 21 from the front part of the mechanical chamber 21. At this time, the rear end of the hanging rail 45 attached to the cooling box 22 is positioned on the front part of the support rail 51 fixed to the thermal insulation box member 2. Moreover, the cooling unit R is slid rearwards until the rear end of the hanging rail 45 on the cooling box 22 side abuts on the stopper 54 formed on the rear end of the support rail 51 on the thermal insulation box member 2 side. Accordingly, the cold air suction port 27 and cold air discharge port 28 formed in the cooling box 22 can be precisely positioned in such a manner as to face the lower sides of the cold air suction port 14 and cold air discharge port 15 formed in the bottom wall 2A of the thermal insulation box member 2. The leak of the cold air by simplification of the attaching operation and front/rear shifts after the fixing of the cooling box 22 can be inhibited.

Moreover, while the cold air suction port 27 and cold air discharge port 28 of the cooling box 22 are disposed under the cold air suction port 14 and cold air discharge port 15 of the bottom wall 2A of the thermal insulation box member 2, the right/left pushup arms 56 constituting the pushup mechanism 55 as described above are rotated forwards substantially at right angles. At this time, since the right/left pushup arms 56, 56 are connected to the rear pushup arms 56, 56 by the link arm 57, the four pushup arms 56 . . . can be rotated by simultaneous operation of the right/left pushup arms 56, 56.

Consequently, the hanging rail 45 supported by the support rail 51 is pushed upwards by a radius fluctuation of the cam face 56B of the pushup arm 56 from the rotary shaft 58 as described above. The only cooling box 22 to which the hanging rail 45 is attached is pushed upwards in a range of the long hole 38A formed in the cooling box support member 38, and the upper face opening of the cooling box 22 can be allowed to abut on the lower face of the bottom wall 2A of the thermal insulation box member 2. At this time, since the sealing material 29 is attached to the opening edge of the cooling box 22 as described above, the upper face opening of the cooling box 22 can be closely attached and pressed onto the bottom wall 2A by contraction of the sealing material 29.

Therefore, the cooling box 22 only is pushed up on the thermal insulation box member 2 side, and pressed onto the bottom wall 2A side of the thermal insulation box member 2. Accordingly, the cooling box 22 is attached to the bottom wall 2A of the thermal insulation box member 2 without any trouble, cold air circulation is constituted in such a manner that cold air which has exchanged heat with the cooler 24 is discharged into the storage chamber 6 by the air blower 25 for the cooler via the cold air discharge port 15, and sucked into the cooling chamber 23 via the cold air suction port 14, and the inside of the storage chamber 6 can be cooled.

Especially according to the present embodiment, since the only cooling box 22 is pushed up, the operation is lightened, and operability can be enhanced. As compared with a conventional constitution in which the whole cooling unit R is pushed up toward the bottom wall 2A of the thermal insulation box member 1, since the only cooling box 22 is pushed up, a weight to be pushed up is reduced, the unit in an attached state lowers by its own weight, and a disadvantage that adhesion•sealability with respect to the thermal insulation box member 2 is deteriorated can be inhibited.

Moreover, since the end portions of the hanging rails 45 attached to the opposite side upper portions of the cooling box 22 can be laid and slid on the support rails 51 attached to the bottom wall 2A of the thermal insulation box member 2, the attaching operation of the cooling box 22 is facilitated.

Furthermore, the pushup arms 56 constituting the pushup arm 56 are constituted in such a manner as to push up the opposite end portions of the hanging rails 45 in a longitudinal direction in cooperation by the link arm 57, the hanging rails 45 are supported on the support rails 51. While the cold air discharge port 28 and cold air suction port 27 of the cooling chamber 23 are positioned under the cold air suction port 14 and cold air discharge port 15 of the thermal insulation box member 2, the opposite end portions of the cooling box 22 on the opposite sides can be simultaneously pushed up. The pushup operation is smoothly performed, and sealability between the cooling box 22 and the thermal insulation box member 2 becomes satisfactory.

Especially, in the present embodiment, in the pushup mechanism 55, the radius of the pushup arm 56 from the rotary shaft 58 changes, and the arm has the cam face 56B which abuts on the hanging rail 45. The cam face 56B in a rotated portion whose radius from the rotary shaft 58 increases abuts on the hanging rail 45 to thereby push up the hanging rail 45 in the mechanism. Therefore, the cooling box 22 can be easily pushed up utilizing the rotation of the cam face 56B of the pushup arm 56 and a lever principle.

Moreover, in the present embodiment, while the cooling box 22 is pushed upwards by the pushup arm 56, the front/rear movement of the front end of the hanging rail 45 is restricted by the stopper 53 formed on the front end of the support rail 51, and therefore further stable attachment can be achieved.

It is to be noted that in the present embodiment, the cold storage 1 has been described in detail in which a pair of cold air suction port 14 and cold air discharge port 15 are formed in the bottom wall 2A of the thermal insulation box member 2, and the cooling unit R is attached facing the ports as described above. However, the present invention is applicable to a case where the inside of the thermal insulation box member 2 is divided into a plurality of chambers by partition walls and a plurality of cooling units R are disposed for the respective storage chambers.

Consequently, the number of cooling units R to be attached can be increased in accordance with a volume of the storage chamber. Moreover, the inside of the storage chamber is divided into chambers, and the chambers may be cooled at different temperatures by the different cooling units R.

What is claimed is:

1. A cold storage in which a mechanical chamber is constituted under a storage chamber constituted in a thermal insulation box member, comprising:

a cooling unit in which at least a cooler and a blower contained in a cooling chamber constituted in a cooling box, a compressor, and a condenser are arranged and integrated; and a cold air discharge port and a cold air suction port which are formed in a bottom wall of the thermal insulation box member constituting a ceiling of the mechanical chamber and which connect the inside of the storage chamber to that of the mechanical chamber, wherein at least the compressor and the condenser are disposed on an attachment base outside of the cooling box, the cooling box is disposed on the attachment base in such a manner that the cooling box is movable to upper/lower positions when the attachment base is not moved, and only the cooling box is pushed up in a direction of the bottom wall.

2. The cold storage according to claim 1, further comprising:

a pushup mechanism comprising:

a pair of hanging rails disposed on opposite side upper portions of the cooling box; and a pair of support rails which are positioned on opposite sides of the cold air discharge port and the cold air suction port and which are disposed on the bottom wall of the thermal insulation box member, wherein a discharge side and a suction side of the cooling chamber correspond to lower sides of the cold air discharge port and cold air suction port in a state in which the hanging rails are supported on the support rails, and the pushup mechanism pushes up the only cooling box in the bottom wall direction in the state.

3. A cold storage in which a mechanical chamber is constituted under a storage chamber constituted in a thermal insulation box member, comprising:

a cooling unit in which at least a cooler and a blower contained in a cooling chamber constituted in a cooling box, a compressor, and a condenser are arranged and integrated; and a cold air discharge port and a cold air suction port which are formed in a bottom wall of the thermal insulation box member constituting a ceiling of the mechanical chamber and which connect the inside of the storage chamber to that of the mechanical chamber, wherein at least the compressor and the condenser are disposed on an attachment base, the cooling box is disposed on the attachment base in such a manner as to be movable to upper/lower positions, and the only cooling box is pushed up in a direction of the bottom wall, wherein the thermal insulation box member comprises at least an inner box, an outer box, and an insulating material filled between both the boxes, openings are formed in bottom faces of the inner and outer boxes constituting the bottom wall of the thermal insulation box member, a passage member constituting the cold air discharge port and the cold air suction port between both the openings is disposed in the insulating material, an upper end of the passage member is allowed to abut on a downward flange formed on an opening edge of the inner box bottom face on the side of the insulating material, and a lower end of the passage member is allowed to abut on an upward flange formed on an opening edge of the outer box bottom face on a non-insulating-material-side.

4. The cold storage according to claim 3, wherein the lower end of the passage member is attached to the upward flange from above.

5. The cold storage according to claim 3, further comprising:

an overflow port formed in the cooling box; and a drainboard disposed under the cooler, wherein the drainboard comprises a barrier having a predetermined water passing portion on a windward side of passed air by the blower.

6. A cold storage in which a mechanical chamber is constituted under a storage chamber constituted in a thermal insulation box member, comprising:

a cooling unit in which at least a cooler and a blower contained in a cooling chamber constituted in a cooling box, a compressor, and a condenser are arranged and integrated;

a cold air discharge port and a cold air suction port which are formed in a bottom wall of the thermal insulation box member constituting a ceiling of the mechanical chamber and which connect the inside of the storage chamber to that of the mechanical chamber, wherein at least the compressor and the condenser are disposed on an attachment base, the cooling box is disposed on the attachment base in such a manner as to be movable to upper/lower positions, and the only cooling box is pushed up in a direction of the bottom wall;

a pushup mechanism comprising:

a pair of hanging rails disposed on opposite side upper portions of the cooling box; and a pair of support rails which are positioned on opposite sides of the cold air discharge port and the cold air suction port and which are disposed on the bottom wall of the thermal insulation box member, wherein a discharge side and a suction side of the cooling chamber correspond to lower sides of the cold air discharge port and cold air suction port in a state in which the hanging rails are supported on the support rails, and the pushup mechanism pushes up the only cooling box in the bottom wall direction in the state, wherein the thermal insulation box member comprises at least an inner box, an outer box, and an insulating material filled between both the boxes, openings are formed in bottom faces of the inner and outer boxes constituting the bottom wall of the thermal insulation box member, a passage member constituting the cold air discharge port and the cold air suction port between both the openings is disposed in the insulating material, an upper end of the passage member is allowed to abut on a downward flange formed on an opening edge of the inner box bottom face on the side of the insulating material, and a lower end of the passage member is allowed to abut on an upward flange formed on an opening edge of the outer box bottom face on a non-insulating-material-side.

7. The cold storage according to claim 6, wherein the lower end of the passage member is attached to the upward flange from above.

8. The cold storage according to claim 6, further comprising:

an overflow port formed in the cooling box; and a drainboard disposed under the cooler, wherein the drainboard comprises a barrier having a predetermined water passing portion on a windward side of passed air by the blower.

9. The cold storage according to claim 4, further comprising:

an overflow port formed in the cooling box; and a drainboard disposed under the cooler, wherein the drainboard comprises a barrier having a predetermined water passing portion on a windward side of passed air by the blower.

10. The cold storage according to claim 7, further comprising:

an overflow port formed in the cooling box; and a drainboard disposed under the cooler, wherein the drainboard comprises a barrier having a predetermined water passing portion on a windward side of passed air by the blower.

* * * * *